US007453225B2

(12) United States Patent
Friberg

(10) Patent No.: US 7,453,225 B2
(45) Date of Patent: Nov. 18, 2008

(54) IMPULSE WRENCH WITH ANGLE SENSING MEANS

(75) Inventor: John Robert Christian Friberg, Nacka (SE)

(73) Assignee: Atlas Copco Tools AB, Nacka (SE)

( * ) Notice: Subject to any disclaimer, the term of this patent is extended or adjusted under 35 U.S.C. 154(b) by 16 days.

(21) Appl. No.: 10/581,108

(22) PCT Filed: Nov. 30, 2004

(86) PCT No.: PCT/SE2004/001767

§ 371 (c)(1),
(2), (4) Date: May 31, 2006

(87) PCT Pub. No.: WO2005/053908

PCT Pub. Date: Jun. 16, 2005

(65) Prior Publication Data

US 2007/0103102 A1 May 10, 2007

(30) Foreign Application Priority Data

Dec. 1, 2003 (SE) ..... 0303212

(51) Int. Cl.
*B25B 23/14* (2006.01)

(52) U.S. Cl. ..... 318/450; 388/937; 173/183

(58) Field of Classification Search ..... 173/176, 173/11, 13, 15, 183; 388/937; 318/450, 318/461, 463, 464, 400.37, 400.38
See application file for complete search history.

(56) References Cited

U.S. PATENT DOCUMENTS 4,185,701 A 1/1980 Boys
4,609,089 A 9/1986 Kobayashi et al.
5,637,974 A * 6/1997 McCann ..... 318/701

(Continued)

FOREIGN PATENT DOCUMENTS

JP 61-237013 10/1986

(Continued)

OTHER PUBLICATIONS

Patent Abstract of Japan; vol. 018, No. 565, Oct. 28, 1994 & JP 6206172 (Yamazaki Haguruma Seisakusho); Jul. 26, 1994.

(Continued)

*Primary Examiner*—Bentsu Ro
(74) *Attorney, Agent, or Firm*—Frishauf, Holtz, Goodman & Chick, P.C.

(57) ABSTRACT

In an impulse wrench there is provided an impulse unit with a motor driven inertia drive member, and a movement detecting device arranged to detect an angular movement of the inertia drive member. The movement detecting device includes a rotating disc rigidly connected to and co-rotating with the inertia drive member. The impulse wrench also includes a sensing device including four Hall-element type sensors, and the disc has a rim portion which is magnetised to provide a number of magnetic poles for activating the sensors at rotation of the inertia drive member. The sensors are arranged in pairs such that the delivered signals from the sensors in each pair has a relative phase lag of 180 degrees, and the sensors of one of the pairs are arranged to deliver signals with a phase lag of 90 degrees relative to the sensor signals from the other pair.

3 Claims, 2 Drawing Sheets

U.S. PATENT DOCUMENTS

| | | | | |
|---|---|---|---|---|
| 6,479,987 | B1 * | 11/2002 | Marx et al. | 324/207.2 |
| 6,523,442 | B2 * | 2/2003 | Lehnert et al. | 81/467 |
| 6,581,696 | B2 | 6/2003 | Giardino | |
| 6,771,043 | B2 * | 8/2004 | Matsunaga et al. | 320/114 |
| 6,796,525 | B2 | 9/2004 | Johnsson et al. | |
| 6,799,644 | B2 * | 10/2004 | Hoop et al. | 173/201 |
| 6,843,326 | B2 | 1/2005 | Tambini | |
| 6,998,813 | B2 * | 2/2006 | Heizmann et al. | 318/653 |
| 2002/0020538 | A1 | 2/2002 | Giardino | |
| 2003/0098167 | A1 | 5/2003 | Giardino | |
| 2003/0102140 | A1 | 6/2003 | Giardino | |
| 2004/0011920 | A1 | 1/2004 | Johnsson et al. | |
| 2004/0050567 | A1 | 3/2004 | Tambini | |
| 2004/0129090 | A1 | 7/2004 | Schoeps | |
| 2004/0182588 | A1 * | 9/2004 | Tokunaga et al. | 173/2 |
| 2004/0263130 | A1 * | 12/2004 | Matsunaga et al. | 322/17 |
| 2006/0113096 | A1 * | 6/2006 | Yamamoto | 173/1 |

FOREIGN PATENT DOCUMENTS

| | | | |
|---|---|---|---|
| JP | 6-206172 | | 7/1994 |
| WO | WO 02/83366 | A1 | 4/2002 |
| WO | WO 02/98612 | A1 | 5/2002 |
| WO | WO 02083366 | A1 | 10/2002 |
| WO | WO 02098612 | A1 | 12/2002 |
| WO | WO 2004/018153 | A2 | 8/2003 |
| WO | WO 2004018153 | A2 | 3/2004 |

OTHER PUBLICATIONS

Patent Abstract of Japan; vol. 011, No. 079, Mar. 11, 1987 & JP 61237013 (Toshiba Corp.); Oct. 22, 1986.

* cited by examiner

IMPULSE WRENCH WITH ANGLE SENSING MEANS

CROSS-REFERENCE TO RELATED APPLICATIONS

This application is a U.S. National Phase Application under 35 USC 371 of International Application PCT/SE2004/001767 filed Nov. 30, 2004.

FIELD OF THE INVENTION

The invention relates to an impulse wrench in which an impulse unit comprises a motor driven inertia drive member, and an angle sensing device is arranged to detect the angular movement of the drive member.

BACKGROUND OF THE INVENTION

A certain type of angle sensing device used in impulse wrenches is based on detection of magnetic poles of a rotating element passing a Hall-element type sensor. A problem concerned with this type of angle sensing device is that it is easily disturbed by external magnetic fields caused by for instance magnetic bits attached to the output shaft of the wrench.

An impulse wrench of a similar type is described in WO 02/083366.

OBJECT OF THE INVENTION

The object of the invention is to provide an impulse wrench including an angle sensing device of the magnetically activated Hall-element type where the Hall-elements are arranged so as to prevent the delivered signals from being influenced by external magnetic fields.

A preferred embodiment of the invention is described below in further detail with reference to the accompanying drawings.

DETAILED DESCRIPTION

Figure 1:
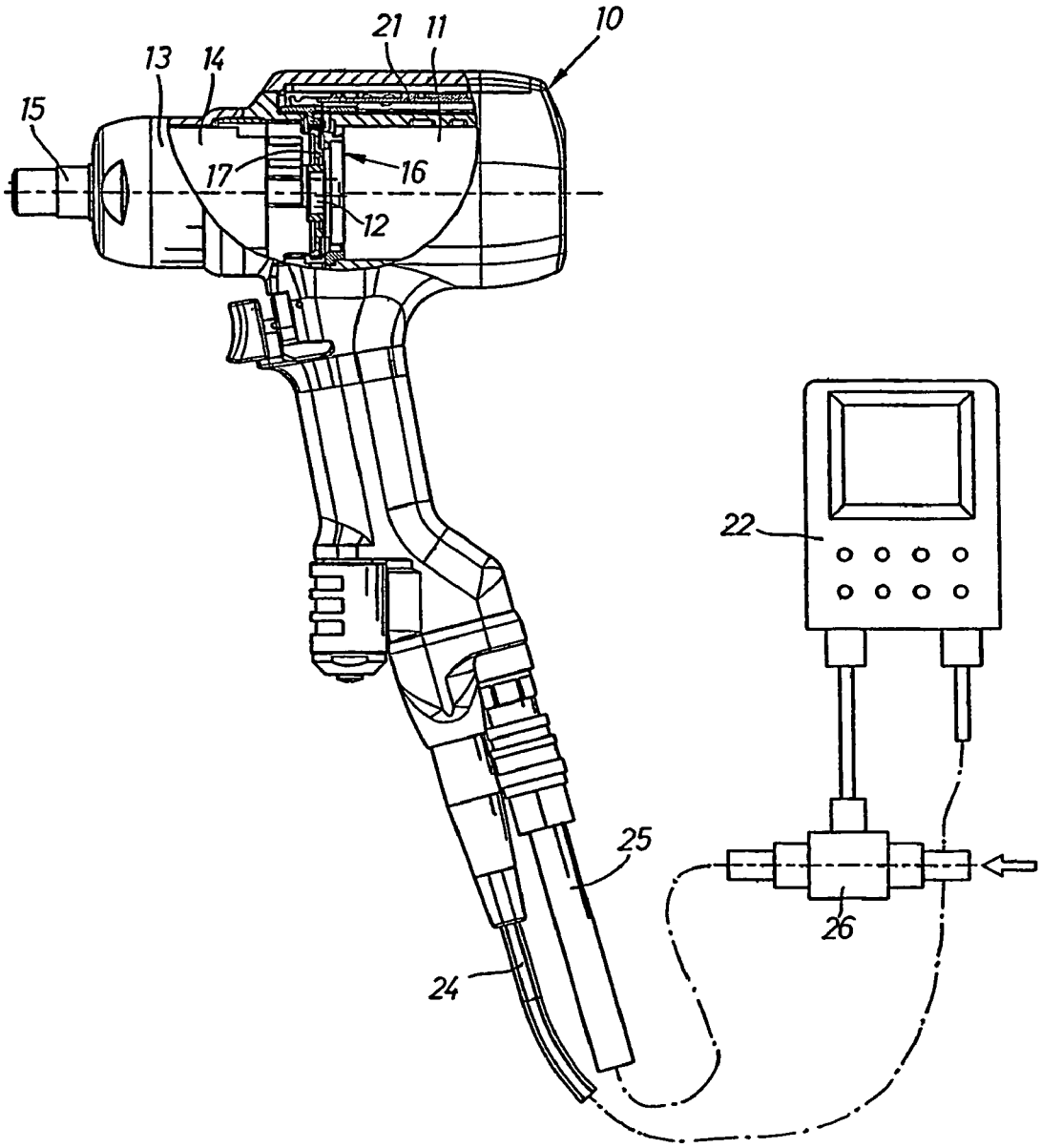
FIG. 1 shows schematically a power tool system including an impulse wrench according to the invention.
Figure 2:
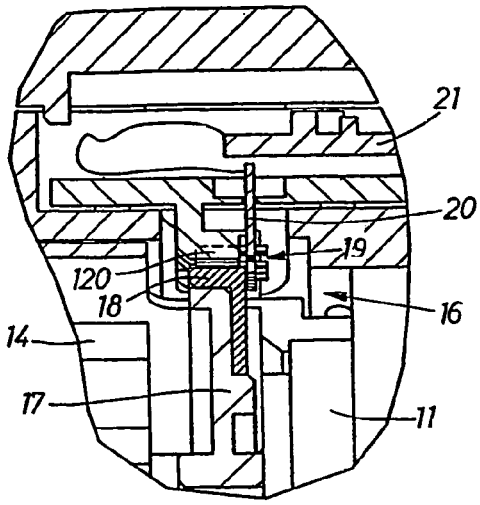
FIG. 2 shows an enlarged fractional view of the impulse wrench shown in FIG. 1 and illustrates the angular movement sensing device.

The power tool system illustrated in FIG. 1 comprises a pneumatic impulse wrench 10 including a motor 11 with a rotor 12, an impulse unit 13 including an inertia drive member 14 connected to the motor rotor 12, and an output shaft 15. The impulse wrench 10 further comprises an angular movement detecting device 16 which includes a disc 17 which is rigidly affixed to and co-rotating With the inertia drive member 14. The disc 17 is provided with a rim portion 18 magnetised to provide a number of magnetic poles, for instance 32 positive and 32 negative poles, equally distributed along the periphery of the rim portion 18. A stationary sensing device 19 is located approximately to the magnetised rim portion 18 of the disc 17 and arranged to deliver electric signals in response to the movement of the disc 17, i.e. in response to the magnetic poles passing it.

The sensing device 19 comprises a connector board 20 carrying four Hall-element sensors 120*a,b,c,d* each delivering a sinusoidal signal when activated by the magnetic poles of the rim portion 18. The Hall-elements are disposed in two pairs 120*a,c* and 120*b,d*, wherein the sensors in each pair 120*a,c* are disposed in such a way as to deliver signals with a phase lag of 180 degrees relative to each other. The Hall-elements 120*b,d* of the other pair deliver signals with a phase lag of 90 degrees relative to the Hall-elements 120*a,c* of the first pair.

Figure 3:
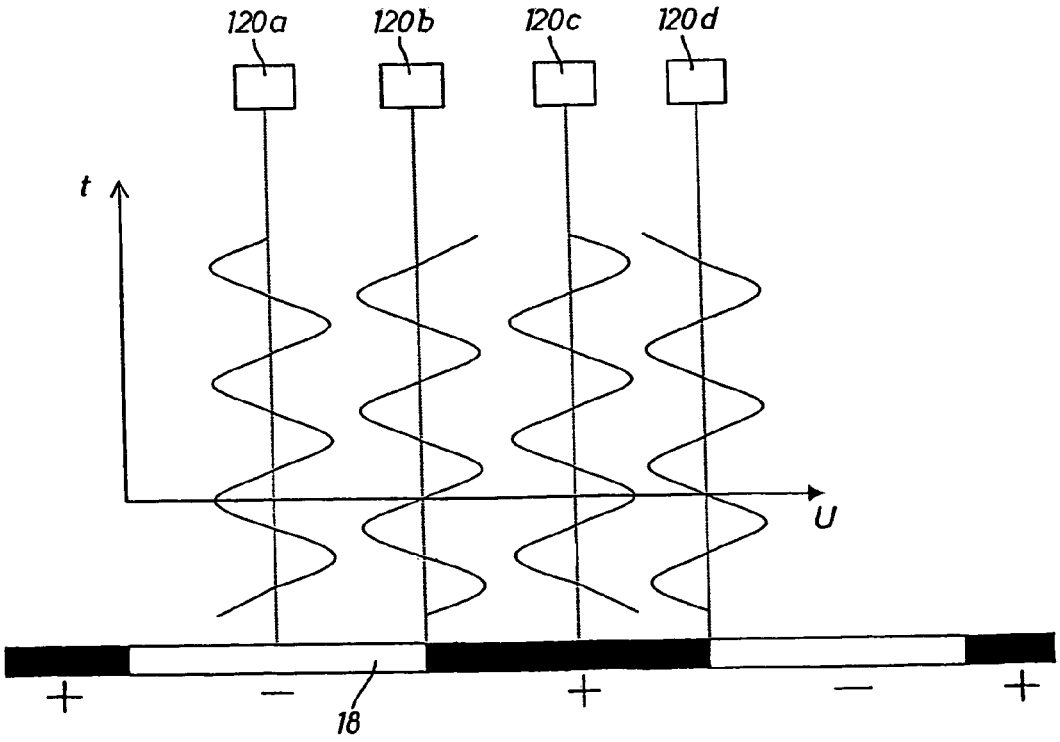
FIG. 3 shows a schematic illustration of the magnetically activated angle sensors.

The diagram shown in FIG. 3 shows the sensor signal curves as voltage U over time t. As illustrated in FIG. 3, the rim portion 18 comprises a alternating positive and negative magnetic poles, and in the very position shown in FIG. 3 the sensor 120*a* coincide with a negative pole resulting in a negative top value of the sinus signal. Sensor 120*c* coincides with a positive pole and provides a positive top value of the sinus signal. In the other pair, the sensors 120*b,d* coincide with a transition points between positive and negative poles and provide in that very instant nil value signals.

By arranging the Hall-elements of one of the pairs such that a signal phase lag of 90 degrees is accomplished relative to the signals of the other pair there is obtained information about the direction of rotation of the inertia drive member 14. By providing a 180 degree phase lag between the Hall-element signals in each pair there is obtained a kind of protection for occurring external disturbing magnetic fields in that a difference in value between the signals from the Hall-elements in each pair is calculated.

The Hall-elements 120*a-d* and connector board 20 is coupled to a circuit board 21 which carries a number of electronic components (not shown) for treating the angle signals delivered by the Hall-elements as described above and sending secondary signals to a stationary programmable control unit 22 via a multi-core cable 24. Pressure air is supplied to the impulse wrench via a hose 25 and a flow regulating valve 26 which communicates with a pressure air source and which is connected to the control unit 22 for receiving operating signals. The flow regulating valve 26 is of the type that is able to adjust the air flow magnitude successively in the range between zero and full power flow as determined by the signals delivered by the control unit 22.

The signals delivered by the movement detecting device 16 correspond to the rotational movement of the drive member 14 and are used for calculating not only the speed and retardation of the drive member 14 but also the installed torque, because with the knowledge of the total inertia of the rotating parts, i.e. the drive member 14 and the connected motor rotor 12, the energy and hence the installed torque magnitude of each delivered torque impulse may be calculated. This method of torque calculation is previously described per se in the above mentioned WO 02/083366.

Based on this previously described torque determination method the operation of the impulse wrench is governed by controlling the pressure air supply to the impulse wrench motor via the flow regulating valve 26. As a set target torque level is reached the flow regulating valve 26 is instructed to reduce the air supply flow so as to interrupt the tightening process either by stopping the impulse wrench completely or by maintaining the installed torque magnitude via a continued impulse delivery at a further reduced torque magnitude in each impulse.

It is to be understood that the embodiments of the invention is not limited to the above described example but may be freely varied within the scope of the claims. Accordingly, the invention is as well applicable on electrically powered impulse wrenches where the rotational movement of the inertia drive member is detected the same way, i.e. via four Hall-elements arranged according to the claims.

The invention claimed is:

1. An impulse nut runner, comprising:

an output shaft, a motor with a rotor, an impulse unit connecting the motor to the output shaft and including an inertia drive member rigidly connected to the rotor of the motor, a rotation detecting device comprising a ring element rigidly secured to the drive member and magnetised with a number of magnetic poles equidistantly distributed along a periphery of the ring element, and a sensing device mounted approximately to the ring element and arranged to deliver electric signals in response to passing of said magnetic poles at rotation of the drive member, wherein said sensing device comprises four Hall-elements each delivering a sinusoidal electric signal at rotation of the drive member, and wherein said Hall-elements are disposed in two pairs, and the Hall-elements in each pair are arranged to deliver signals with a 180 degrees phase lag relative to each other and with a 90 degrees phase lag relative to the Hall-elements of the other pair.

2. The impulse nut runner according to claim 1, wherein said Hall-elements are carried on a printed connector board.

3. The impulse nut runner according to claim 2, wherein a circuit board mounted in a housing is connected to said connector board and carries a number of electronic components for treating and forwarding said signals delivered by said sensing device to an operation control unit.

* * * * *